United States Patent [19]

Sharp

[11] Patent Number: 4,591,835

[45] Date of Patent: May 27, 1986

[54] REMOTELY ACTIVATABLE ALARM SYSTEM

[76] Inventor: Graham D. F. Sharp, Sportsmans End, West Malling, Kent, England

[21] Appl. No.: 592,369

[22] Filed: Mar. 22, 1984

[30] Foreign Application Priority Data

Mar. 25, 1983 [GB] United Kingdom ..... 8308228

[51] Int. Cl.[4] ..... G08B 15/02; G08B 29/00

[52] U.S. Cl. ..... 340/574; 340/539; 340/571; 340/689; 340/696

[58] Field of Search ..... 340/574, 539, 571, 696, 340/501, 689

[56] References Cited

U.S. PATENT DOCUMENTS

| | | | |
|---|---|---|---|
| 1,817,002 | 8/1931 | Halstead | 340/689 |
| 3,551,906 | 12/1971 | Cooper | 340/539 |
| 3,833,895 | 9/1974 | Fecteau | 340/539 |

FOREIGN PATENT DOCUMENTS

| | | | |
|---|---|---|---|
| 0033661 | 8/1981 | European Pat. Off. . | |
| WO83/00402 | 2/1983 | PCT Int'l Appl. . | |
| 2019625 | 10/1979 | United Kingdom | 340/574 |
| 2052820 | 1/1981 | United Kingdom . | |

OTHER PUBLICATIONS

Sparrow, W. R. et al., "Radio Controlled Emergency Notification Device" IBM Tech. Disc. Bulletin, XII, 12, May, 1970.

*Primary Examiner*—Glen R. Swann, III

*Attorney, Agent, or Firm*—Fleit, Jacobson, Cohn & Price

[57] ABSTRACT

A remotely activatable alarm system comprising a portable security container, a handle for carrying the security container, a manually operable lock for locking and unlocking the security container, smoke and sound outlets provided in a bottom wall of the security container, a smoke emitting device which is positioned in the security container, an audio alarm which is positioned in the security container, a receiver which is positioned in the security container and which is for activating the smoke emitting device and the audio alarm consequent upon receiving a transmitted signal, and a transmitter for transmitting the transmitted signal to the receiver from a position remote from the security container.

9 Claims, 5 Drawing Figures

REMOTELY ACTIVATABLE ALARM SYSTEM

BACKGROUND OF THE INVENTION

This invention relates to a remotely activatable alarm system.

Portable security containers such as hand held cases and bags are well known. As they are being carried by security guards, bank messengers or other personnel between banks, firms or other secure installations, attempts are often made to snatch the security containers. The known security containers have been provided with smoke emitting devices and audio alarm means. The smoke from the smoke emitting devices first provides a visual warning of an attempt to gain unauthorised entry into the security container and secondly stains the contents of the security container, which contents may be paper money, postal orders, other security papers, coins, precious stones or jewellery. The audio alarm means provides an audible warning of the attempt to gain unauthorised entry into the security container, as for example by attempting to snatch or otherwise remove the container.

With the known portable security containers, the smoke emitting device and the audio alarm means are activated as the security container is snatched from the holder. More specifically, the holder will usually have a chain attached to his wrist and the end of the chain remote from the holder's wrist will form part of switch means for activating the smoke emitting device and the audio alarm means. Usually, the chain will terminate in a jack plug device which is pulled out of its socket as the security container is snatched from its holder.

A disadvantage of the known security containers is that the activation of the smoke emitting device and the audio alarm means at the instant when the would-be thief snatches the security container may tend to panic the thief. In his panic, the thief may resort to violence, which is detrimental to the holder of the security container. In the worst instance, the would-be thief may be carrying a fire-arm which he may discharge in panic at the holder of the security container or at random into an onlooking or pursuing crowd of persons. Also, alarm activation by chains and other methods of activation can be seen from the outside and therefore the security container can be recognised for what it is.

SUMMARY OF THE INVENTION

It is an aim of the present invention to provide a remotely activatable alarm system which can be activated at any desired time such for example as when a would-be thief has moved away from the immediate scene of the crime and the likelihood of violence due to panic in the first few seconds of the crime is not enhanced. It is also an aim of the invention to provide an alarm system which need not immediately be apparent by having a container that can be plain and ordinary.

Accordingly, this invention provides a remotely activatable alarm system comprising a portable security container, a handle for carrying the security container, at least one manually operable lock for locking and unlocking the security container, at least one smoke outlet provided in a bottom wall of the security container, at least one sound outlet provided in the bottom wall of the security container, a smoke emitting device which is positioned in the security container and which is for providing a visual warning of an attempted theft and for staining the contents of the security container, an audio alarm means which is positioned in the security container and which is for providing an audible warning of the attempted theft, receiver means which is positioned in the security container and which is for activating the smoke emitting device and the audio alarm means consequent upon receiving a transmitted signal, and transmitter means for transmitting the transmitted signal to the receiver means from a position remote from the security container, the receiver means and the transmitter means each being provided with an encoding device whereby the receiver means and the transmitter means are signal encodable for operation on a pre-programmed signal frequency, the security container being such that the manually operable lock for locking and unlocking the security container operates independently of the transmitter means whereby valuables to be placed in and removed from the security container can be under the control of financial personnel who have no control over the transmitter means, and whereby the entire security container can be under the control of security personnel who have no control over the manually operable lock and thus over the valuables in the security container, and the smoke and sound outlets being not noticeable as the security container is carried by the handle in an upright position whereby a would-be thief is not prematurely alerted to the presence of the smoke emitting device and the audio alarm means in the security container and is thus not provoked into violent action whilst the security container is still being held by an authorised holder of the security container.

With the alarm system of the present invention, spurious activation of the alarm system is substantially eliminated by having the receiver means and the transmitter means signal encodable so that they only operate on the pre-programmed signal frequency with a certain code. In use of the alarm system, the desired operational signal frequency and code can be changed at will and can be programmed into the receiver means and the transmitter means shortly before moving the portable security container, thus obviating the likelihood of a would-be thief finding out the operational signal frequency in advance and jamming the frequency. The transmitter means can be carried by the holder of the security container so that the holder of the security container can activate the alarm system when he believes that the would-be thief has got sufficiently far away for it to be relatively safe to activate the alarm system. For example, activation of the alarm system could be delayed until the thief is about to jump into a get away car. Alternatively, the transmitter means may be carried by a separate person who may walk behind the holder of the security container at a safe distance. Thus, if an attempt is made to snatch the security container, the holder of the security container can meekly submit or merely throw the security container down and run away. Activation of the alarm system at a desired moment can easily be achieved by the second person carrying the transmitter means. The second person carrying the transmitter means need not even walk behind the holder of the security container, and the holder of the transmitter means could position himself at some high point, for example on the top of a roof of a building, where he can see the entire walk of the person carrying the security container.

The security container may be produced in a variety of shapes and sizes and it may be produced, for example, as an executive carrying case or as a carrying bag.

Preferably, the security container includes key-operated switch means for switching the entire alarm system on and off. A key-hole for the key-operated switch means may be provided in the bottom wall of the security container to avoid possible prior detection by a would-be thief.

The key operated switch means may be such that the key is turned one way for the on position and then back again for the off position.

The primary transmitter means may have a first switch for activating and de-activating the alarm system, and a second switch for pre-arming the alarm system. The first and second switches are preferably button operated switches but they may be lever operated switches if desired. The second pre-arming switch is operative to help prevent accidental activation of the alarm system, depression of the second pre-arming switch being necessary before the first switch can be depressed to activate the alarm system.

When the second pre-arming switch is actuated, a sound and/or visual means, for example a buzzer, may operate for a short time to indicate that the alarm system is pre-armed, functioning and operational.

When the activating signal is stopped, the audio warning device will immediately cease to operate but, obviously, if the smoke emitting device is in operation, it will not immediately cease to emit smoke.

Each encoding device may be a lever operated or push button operated encoding device.

The smoke emitting device may contain a powder which is caused to burn by the activation of a detonator. The powder can be a lactose powder. The smoke can be variously coloured and one presently preferred colour is red.

The audio alarm means is preferably a siren alarm device although a bleeper alarm device may also be employed. The audio alarm means may be arranged to operate for a predetermined time, for example 20 minutes. The audio alarm means advantageously operates at from 110 to 115 decibells and it is preferably modulated to simulate a police siren warning signal or a recognisable tone.

Advantageously, the alarm system is provided with time delay means such that the audio alarm means operates a predetermined time before the smoke emitting device. This allows the alarm system to be tested if desired by an operator to the extent that the audio alarm means can be tested and the smoke emitting device will not operate providing the alarm system is deactivated by the primary transmitter means within the time delay period. The time delay period may be, for example, 15 seconds.

The smoke from the smoke emitting device will usually be such that it will not permanently stain the paper contents of the security container and the stain can often be leeched out. If it is desired to substantially permanently stain the paper contents of the security container, then the security container may additionally include a liquid dye emitting device to substantially permanently stain the paper contents of the security container thereby to render the paper contents of the security container substantially permanently easily identifiable. A presently preferred liquid dye is produced and sold in Sweden by a firm called Stellar Marketing. The liquid dye is preferably green but other colours of liquid dye may be employed.

When the smoke emitting device is actuated, smoke may ensue from the device for approximately one minute. This is because a burning action is taking place, causing the coloured smoke.

The alarm system may be such that the transmitter means has a mercury switch that operates the alarm system if personnel carrying the transmitter means or the transmitter means itself, are knocked flat.

The alarm system may also include other transmitter means effective solely to activate the alarm system, whereby the said other transmitter means can be carried by secondary personnel and the first recited transmitter means can be carried by primary personnel having a controller function.

The said other transmitter means may also be provided with a mercury switch.

The alarm system may be such that the security container includes a tilt transmitter. Thus if the security container is picked up and tilted or knocked over by a would-be thief, then the alarm system becomes activated.

The alarm system may also include passive infra-red heat sensing means for activating the alarm system from a pre-armed condition in response to an increase in environmental heat caused by the body heat of a would-be thief. This is a particularly useful feature if the security container is to be left in a hotel room.

The alarm system may be sold with rechargeable batteries and a battery charger.

The security container may be provided with an indicator light, for example a red light, which becomes illuminated when the battery or batteries used to power the electrical circuitry of the alarm system have insufficient power in them for operation. The indicator light may be arranged to glow until the battery or batteries are fully recharged.

The security container may also be provided with an indicator light which becomes illuminated when a battery or batteries for the alarm system need replacing or charging. During recharging, another indicator light may be arranged to come on to indicate that recharging is taking place.

The security container may be made from a variety of materials including plastic materials and leather. The security container may also be provided with a slash-resisting lining made, for example, of wire mesh.

The security container may be made from plastics materials of the type that can be washed substantially clean of the dye from the smoke emitting device or liquid dye system. A presently preferred plastics material is polypropylene. The security container can thus be cleaned and reused after an attempted theft.

BRIEF DESCRIPTION OF THE DRAWINGS

Embodiments of the invention will now be described solely by way of example and with reference to the accompanying drawings in which.

DETAILED DESCRIPTION OF THE PREFERRED EMBODIMENT

Figure 1:
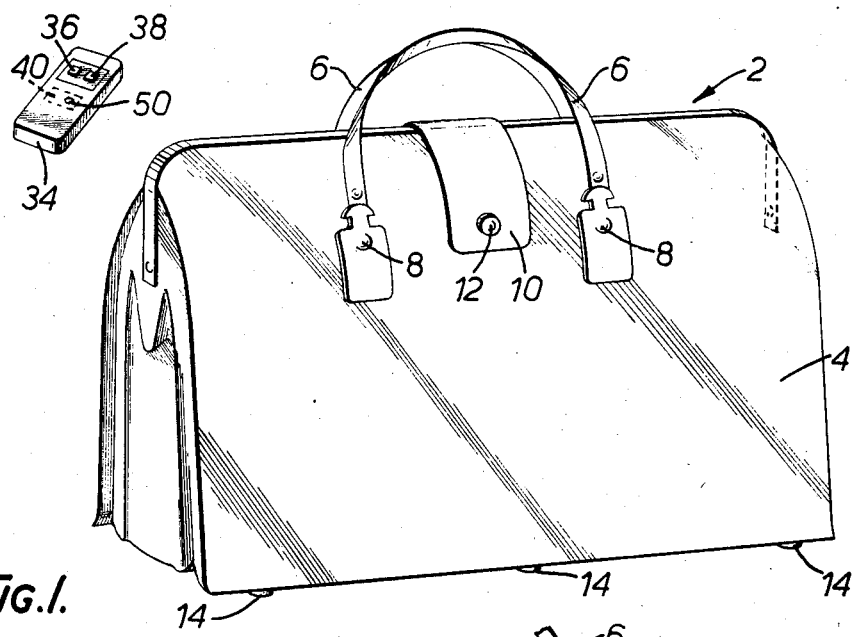
FIG. 1 shows a first alarm system with a first security container in accordance with the invention.
Figure 2:
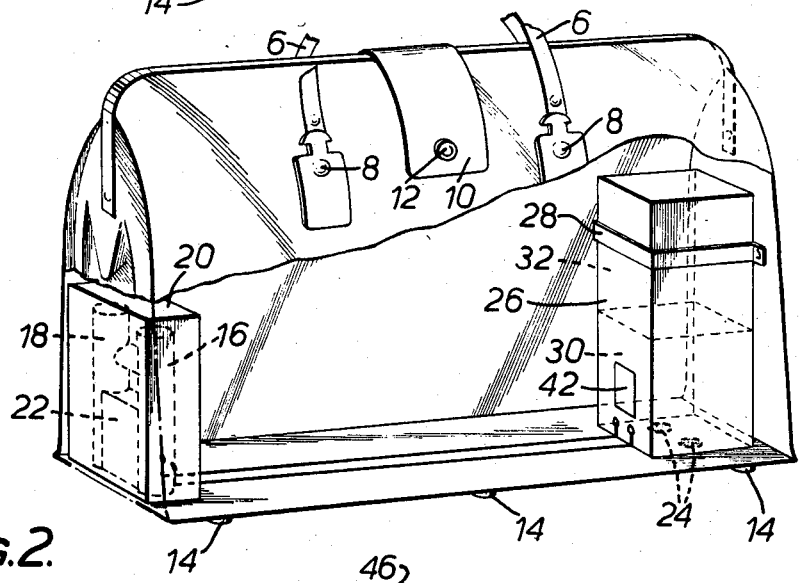
FIG. 2 shows part of the alarm system that is installed in the security container shown in FIG. 1.
Figure 3:
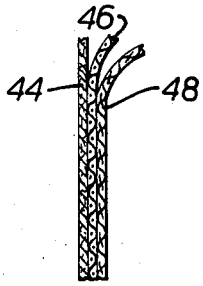
FIG. 3 is a cross section through a part of the wall of the security container shown in FIG. 1.

Referring to FIGS. 1 to 3, there is shown a remotely activatable alarm system 2 comprising a portable security container 4. The security container 4 is in the form of a bullion case as shown and it has a pair of handles 6 which are fixed to side walls of the security container 4 by rivets 8. The security container 4 is provided with a fold over flap 10 which is lockable in position by a lock 12. The flap 10 is preferably steel lined to prevent cutting. The lock 12 may be a 5-lever or a 5-pin tumbler lock. The security container 4 is provided with a plurality of heavy duty moulded rubber feet 14.

As shown in FIG. 2, the security container 4 is provided with a pair of smoke emitting devices 16, 18 which are housed in a housing 20 and which have smoke outlets in the bottom wall of the security container 4. Positioned between the smoke emitting devices 16, 18 is audio alarm means in the form of an audio alarm device 22. A pair of speakers (not shown) are mounted underneath the audio alarm device 22 and in the bottom wall of the security container 4 so that the sound can easily penetrate outside the security container 4. A similar pair of twin speakers 24 are mounted at the other end of the base of the security container 4.

Above the speakers 24 is mounted a housing 26. The housing 26 is held in position by a strap 28. Inside the housing 26 is mounted receiver means 30 which is for electronically activating the smoke emitting devices 16, 18 and the audio alarm device 22. Also inside the housing 26 is mounted a rechargable battery 32 for operating the electrical circuitry (not shown) for operating the smoke emitting devices 16, 18 and the audio alarm device 22.

Although the smoke emitting devices 16, 18 and the audio alarm means 22 are electronically activated, the necessary circuitry is simply constructed and is based on known circuits currently in use. Similarly the receiver means 30 can be a standard receiver means designed merely for receiving a signal and becoming activated consequent upon receiving the received signal.

The alarm system 2 further comprises a dual channel transmitter means 34 for transmitting the transmitted signal to the receiver means 30 from a position remote from the security container 4. The transmitter means 34 may be obtained as a standard item from The Linear Corporation, of California, United States of America. The transmitter means 34 has a first activating and deactivating button 36 and a second pre-arming button 38. The pre-arming button 38 must be operated to pre-arm the system before the button 36 can be depresed to activate the smoke emitting devices 16, 18 and the audio alarm device 22. On depression of the pre-arming button, a buzzer in the security conainer 4 or in the transmitter means 34 may sound for approximately 10 seconds to indicate that the alarm system 2 is pre-armed and is correctly functioning.

Inside the transmitter means 34 there is provided an encoding device 40 comprising eight numbered levers which can be moved between an on position and an off position to set a predetermined code in the transmitter means 34 so that it operates on a frequency predetermined by the set code. The receiver means 30 is provided with a similar encoding device 42 so that a similar code can be programmed into the receiver means 30. Thus shortly before use, a predetermined code can be set so that the alarm system 2 will only operate on a predetermined frequency and the chances of a spurious radio signal operating the alarm system 2 are virtually negligible, as are the chances of a would-be thief knowing the predetermined operational frequency of the alarm system 2.

FIG. 3 shows that the security container 2 is reinforced such that its walls comprise a leather outer surface 44, a knitted wire mesh middle portion 46 and a heavy cotton lining 48.

The transmitter means 34 is provided with a light 50 which glows red when the buttons 36, 38 are depressed.

Figure 4:
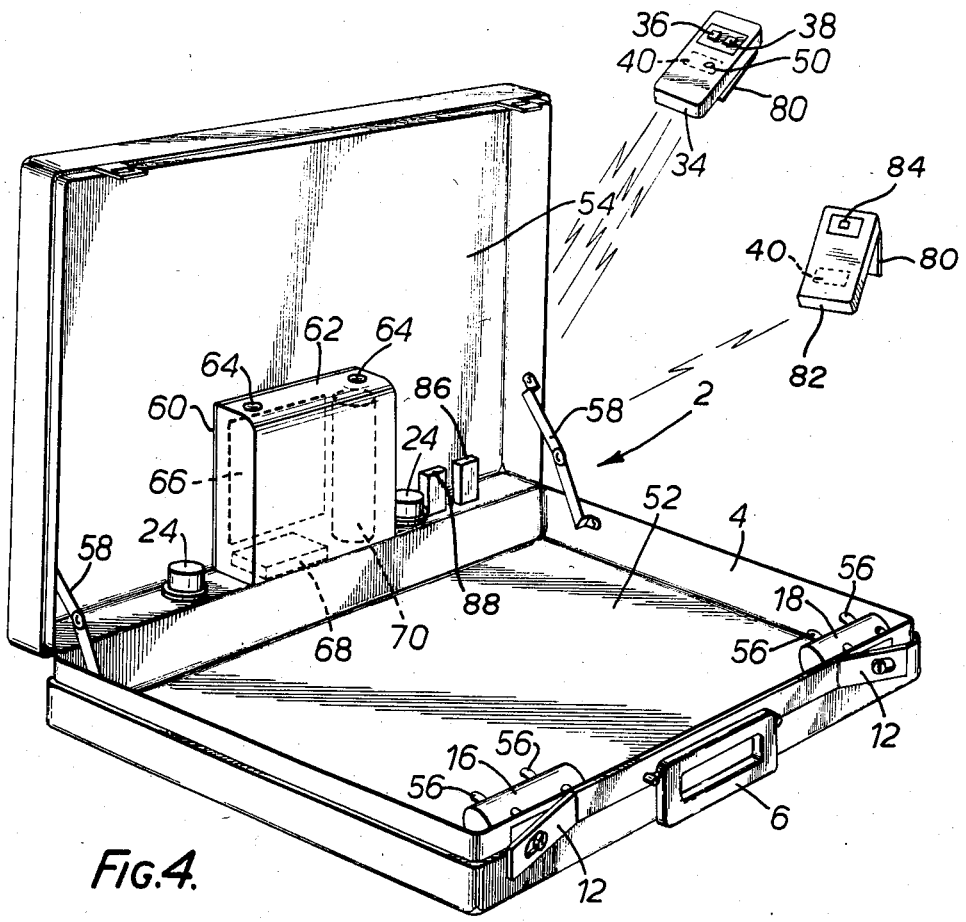
FIG. 4 shows a second alarm system with a second security container in accordance with the invention.
Figure 5:
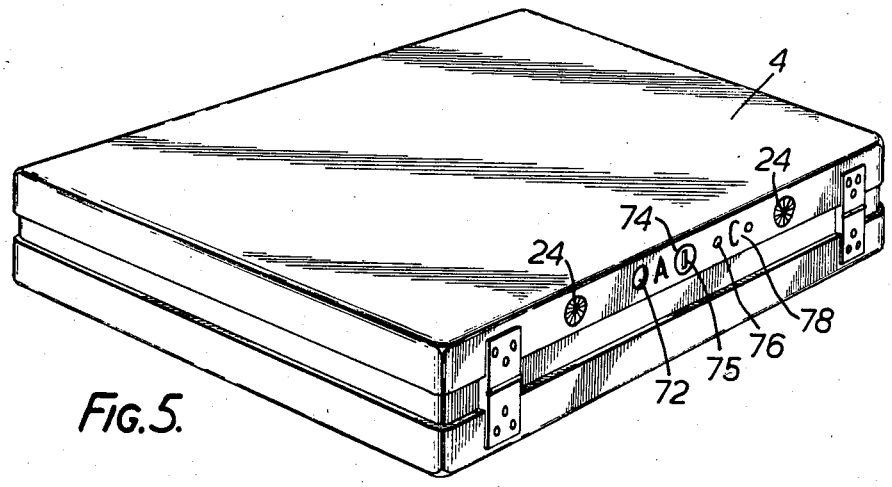
FIG. 5 shows the bottom wall of the portable security container shown in FIG. 4, the portable security container as shown in FIG. 5 being in a closed position.

Referring now to FIGS. 4 and 5, there is shown a second alarm system 2 comprising a second security container 4. In FIGS. 4 and 5, similar parts as in FIGS. 1 to 3 have been given similar reference numerals and their precise construction and operation will not again be given.

In FIGS. 4 and 5, the security container 2 is in the form of a flat brief case having a base 52 and a lid 54. The base 52 is provided with a pair of smoke emitting devices in the form of smoke cannisters 16, 18 which are held in position by clips 56. The lid 54 is held open by stays 58.

The lid 54 of the security container 4 is provided with a soft walled leather or rigid plastics container 60 having a lid 62 which clips in position by means of press-studs 64. Inside the container 60 is a printed circuit board 66 containing the circuitry necessary for the alarm system 2, a rechargable battery 68 and a third smoke canister 70.

The smoke canisters 16, 18 can be arranged to discharge smoke directly into the security container 4 to stain the contents of the security container 4. The smoke canister 70 can be arranged to discharge its contents directly to the outside environment through a smoke orifice 72.

It will be noticed that smoke orifice 72 and the speakers 24 are located in the bottom wall of the security container 4 so that when the security container 4 is standing in an upright position or is being carried in its normal upright position, the smoke outlet 72 and the speakers 24 will not be immediately visible and so will not give a would-be thief a warning that the security container 4 is provided with the alarm system 2.

The bottom of the security container 4 as shown in FIG. 5 also includes key operated switch means including a keyhole member 74 having a keyhole 75 for receiving a key (not shown). The key operated switch means is for switching the entire alarm system 2 on and off as desired.

The bottom wall of the security container 4 also includes a pair of lights 76, 78 as shown.

The key is inserted into the keyhole 75 in operation of the alarm system 2 and turned clockwise towards the letter C to activate the system. The key can then be removed and should be kept in a safe place. The pre-arming button 38 of the transmitter means 34 can then be activated. The activating button 36 is pressed when it is desired to activate the alarm system 2. On pressing the button 36, the audio alarm device 22 will immediately operate and, after a 15 second delay, the smoke cannisters 16, 18, 70 will operate. In case of accidental activation of the sound unit, or during testing, the operation of the alarm system 2 can be stopped by pressing the button 36 for a second time but this has to be done within the 15 second delay. Alternatively, the key can be reinserted in its keyhole and turned to the 12 o'clock off position. When the key is turned to 12 o'clock off position, the alarm system 2 is neutralised and is automatically ready for re-use in the normal manner. It is to be appreciated that the key does not gain entry to the security container 4 so that the person carrying the security container 4 need not carry a key to open the security container 4 or need not know the combination of its lock.

A battery charger (not shown) is preferably provided. In order to charge the open security container 4 as shown in FIG. 4, the charger is plugged into the container 60 where there is a female section (not shown) for taking a charging plug. The charger is then plugged into the mains supply and the key is inserted into the keyhole 75 and is turned to the left to the position A. The light 78 will glow green and will remain illuminated whilst the charging is taking place and until the battery 68 is fully charged. When the battery 68 is fully charged, the light 78 will go out.

When the battery is charged, the key is returned to the 12 o'clock off position and the charging unit is removed. The security container 4 is then ready for reuse.

The light 76 glows red to show when the battery 68 needs recharging.

The battery that is present in the transmitter means 34 should be replaced every 3 months. This battery is accessible from the back of the transmitter case and it may be 9 volt transistor type battery.

Referring again to FIG. 4 it will been seen that the transmitter means 34 is provided with a clip 80 so that the transmitter means 34 can be clipped onto a pocket or the like.

It is to be appreciated that the embodiments of the invention described above have been given by way of example only and that modifications may be effected. Thus, for example, different types and shapes of security container 4 may be employed to those illustrated. Also, if desired, more transmitter means 34 may be provided so that several persons may activate the alarm system 2. If desired, other transmitter means 82 may be provided which are only capable of activating the alarm system 2, via an activating button 84. These said other transmitter means will not be able to pre-arm and deactivate the alarm system 2 and these functions can be retained by a controller in possession of one of the transmitter means 34. Persons in control of the transmitter means 34 or the said other transmitter means can activate the alarm system 2 when it is judged that a would-be thief is at safe distance from a holder of the security container 4. It will thus be apparent that all the holder of the security container 4 need do is to meekly submit to the security container 4 being snatched or to merely throw the security container down and run away. Appropriate activation can then be taken at the desired instance by persons who are holding the transmitter means 34 or the said other transmitter means and who are located a safe distance away from the incident. If desired, the alarm system may be provided with time delay means for delaying operation of both the smoke emitting devices and the audio alarm means, to help to avoid the alarm system being slightly prematurely activated due to panic on the part of the operator. The alarm system may also be provided with a tilt transmitter 86 and a passive infra-red sensor 88.

I claim:

1. A remotely activatable alarm system comprising a portable security container, a handle for carrying the security container, at least one manually operable lock for locking and unlocking the security container, at least one smoke outlet provided in a bottom wall of the security container, at least one sound outlet provided in the bottom wall of the security container, a smoke emitting device which is positioned in the security container and which is for provided a visual warning of an attempted theft and for staining the contents of the security container, an audio alarm means which is positioned in the security container and which is for providing an audible warning of the attempted theft, receiver means which is positioned in the security container and which is for activating the smoke emitting device and the audio alarm means consequent upon receiving a transmitted signal, and transmitter means for transmitting the transmitted signal to the receiver means from a position remote from the security container, the receiver means and the transmitter means each being provided with an encoding device whereby the receiver means and the transmitter means are signal encodable for operation on a pre-programmed signal frequency, the security container being such that the manually operable lock for locking and unlocking the security container operates independently of the transmitter means whereby valuables to be placed in and removed from the security container can be under the control of financial personnel who have no control over the transmitter means, and whereby the entire security container can be under the control of security personnel who have no control over the manually operable lock and thus over the valuables in the security container, and the smoke and sound outlets being not noticeable as the security container is carried by the handle in an upright position whereby a would-be thief is not prematurely alerted to the presence of the smoke emitting device and the audio alarm means in the security container and is thus not provoked into violent action whilst the security container is still being held by an authorised holder of the security container.

2. A remotely activable alarm system according to claim 1 in which the security container includes key operated switch means for switching the entire alarm system on and off.

3. A remotely activatable alarm system according to claim 1 in which the transmitter means has a first switch for activating and de-activating the alarm system, and a second switch for pre-arming the alarm system.

4. A remotely activatable alarm system according to claim 1, in which the alarm system is provided with time delay means such that the audio alarm means operates a predetermined time before the smoke emitting device.

5. A remotely activatable alarm system according to claim 1, in which the transmitter means has a mercury switch that operates the alarm system if personnel carrying the transmitter means or the transmitter means itself, are knocked flat.

6. A remotely activatable alarm system according to claim 1 in which the alarm system includes other transmitter means effective solely to activate the alarm system, whereby the said other transmitter means can be carried by secondary personnel and the first recited transmitter means can be carried by primary personnel having a controller function.

7. A remotely activatable alarm system according to claim 6 in which the said other transmitter means includes a mercury switch.

8. A remotely activatable alarm system according to claim 1, in which the security container includes a tilt transmitter.

9. A remotely activatable alarm system according to claim 1, and including passive infra-red heat sensing means for activating the alarm system from a pre-armed condition in response to an increase in environmental heat caused by the body heat of a would-be thief.

* * * * *